US005667589A

United States Patent [19]

Mailänder

[11] Patent Number: 5,667,589

[45] Date of Patent: Sep. 16, 1997

[54] APPARATUS FOR SUPPLYING A VARNISHING CYLINDER OF A VARNISHING MACHINE WITH A VARNISH FILM

[75] Inventor: Udo Mailänder, Bietigheim-Bissingen, Germany

[73] Assignee: LTG Lfttechnische GmbH, Stuttgart, Germany

[21] Appl. No.: 629,243

[22] Filed: Apr. 8, 1996

[30] Foreign Application Priority Data

Apr. 7, 1995 [DE] Germany ..... 195 13 133.9
Apr. 29, 1995 [DE] Germany ..... 195 15 825.3

[51] Int. Cl.[6] ..... B05C 17/00

[52] U.S. Cl. ..... 118/261; 15/256.5; 15/256.51; 101/363

[58] Field of Search ..... 118/123, 261, 118/413; 427/356, 359; 101/350, 363; 15/256.5, 256.51; 162/281

[56] References Cited

U.S. PATENT DOCUMENTS 3,065,486 11/1962 Scott ..... 162/281
4,181,076 1/1980 Gattus ..... 101/350
5,503,674 4/1996 Hofmann et al. ..... 101/363

FOREIGN PATENT DOCUMENTS 246185 4/1966 Austria .

*Primary Examiner*—Laura Edwards
*Attorney, Agent, or Firm*—Anderson Kill & Olick P.C.

[57] ABSTRACT

An apparatus for supplying a varnishing cylinder of a sheet varnishing machine with a varnish film includes a varnish feed roller for depositing the varnish film on the varnishing cylinder, a pressure roller cooperating with the varnish feed roller for supplying the varnish film, a varnish basin formed between the varnish feed roller and the pressure roller, scraper blades engaging the varnish feed roller and the pressure roller, respectively, and submerged in the varnish basin, and a common device for holding the scrapper blades.

8 Claims, 2 Drawing Sheets

APPARATUS FOR SUPPLYING A VARNISHING CYLINDER OF A VARNISHING MACHINE WITH A VARNISH FILM

BACKGROUND OF THE INVENTION

The present invention relates to an apparatus for supplying a varnishing cylinder of a sheet varnishing machine with a varnish film and including a varnish feed roller for depositing the varnish film on the varnishing cylinder, a pressure roller cooperating with the varnish feed roller for supplying the varnish film, and a varnish basin formed between the varnish feed roller and the pressure roller, with at least one scrapper blade for scrapping varnish from the pressure roller.

Here, the term "varnishing machine" is preferably used for designating a varnishing machine for one-sided varnishing of plate-shaped metal sheets, with the sheets being displaceable between a varnishing cylinder, having an outer surface formed of rubber or another elastic material, and hard pressure cylinder, and with the varnish feed roller having an inelastic outer surface. In a corresponding printing machine or press, usually print ink is transferred from an ink feed roller to a plate cylinder. Here, a sheet varnishing machine is used, e.g., in manufacturing of drink cans, glazing caps, crown caps, where varnishing of inner and outer surfaces precedes printing, which is followed with protective varnishing. In these cases, the varnish should meet specific requirements so that the varnish, upon subsequent pressing or deep-drawing of the sheets, would not crack.

To form a stripe-shaped outer surface of a sheet for enable welding, conventionally elongate recessing doctor blades are used, from which the above-mentioned scrapper blades distinguish by their shape and function. The scrapper blades serve primarily for supplying a varnishing cylinder with a varnish film having a high uniformity, which permits to eliminate varnish splitting and phantom layering by the unused varnish field of the varnishing cylinder when a new varnish film is formed on the varnishing cylinder. Often, intermediate rollers are used which simply smudge the varnish splittings. The use of intermediate rollers increases the cost of the varnishing machines.

Austrian patent N246, 185 discloses a supplying apparatus of the above-mentioned type but relating to an inker mechanism for a printing press, in which an oil ink is used and in which the application roller, which is made of an elastic material, transfers ink onto an engraving roller. There is provided an ink scrapper for forming a dammed area for the ink substance in the vicinity of the contact line of the ink roller and the transfer roller. The scrapper is provided on the ink roller. The ink and the transfer roller are rotatable in the same direction. At that, changing of the circumferential or angular speed of the ink roller relative to the transfer roller is possible. The object of patent No. 246,185 is to provide simple means for operational control of the ink film thickness. The ink, which remains on the transfer roller, after the ink transfer to the engraving plates of the plate cylinder, is transferred back to the dammed area by the transfer roller. There is provided a second ink scrapper on the other half of the ink roller to insure a complete removal of the ink film. The transfer roller, which returns the ink back to the dammed area, is not equipped with any ink scrapper and, therefore, the unused amount of ink does not affect the formation of the new film on the plate cylinder.

The object of the present invention is an apparatus for supplying a varnishing cylinder of a varnishing machine, which would have a simple structure and would take up little space. Another object of the invention is a supplying apparatus of the above-described type in which the unused varnish field on the varnishing cylinder does not affect formation of a new film on the varnishing cylinder.

A further object of the invention is a supplying apparatus of the above-mentioned type which would insure convenient cleaning and would provide for a more rapid change of the varnish when necessary.

SUMMARY OF THE INVENTION

These and other objects of the invention, which will become apparent hereinafter, are achieved by providing two scrapper blades which cooperate with both pressure and varnish feed rollers, which are submerged into the varnish basin, and which supported by a common holding device.

The two scrapper blades insure removal of the varnish from both pressure and feed rollers which results in the optimal formation of a new varnish film on both rollers, and non-uniformity, which might have resulted from varnish splitting-off or other varnish condition, is eliminated. Providing only two rollers substantially reduces the space required for the supplying apparatus. Arranging the two scrapper blades adjacent to each other further reduces the space required for the apparatus. Providing a common holding device insure simultaneous lifting of both blades and facilitate cleaning, as well as removal of the varnish unit, which accelerates varnish change. Adjustment of the scrapper blade is insured by their arrangement on opposite sides of the holding device. This arrangement also insureds an equilibrium of forces acting on both scrapper blades. Because both scrapper blades are submerged into the varnish basin, all of the varnish splittings and the like are almost immediately return back to the basin.

A particular advantage of the inventive apparatus consists in that a rather small varnish catch system is required, and a free surface of the apparatus for removal of solvent gases is rather limited.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
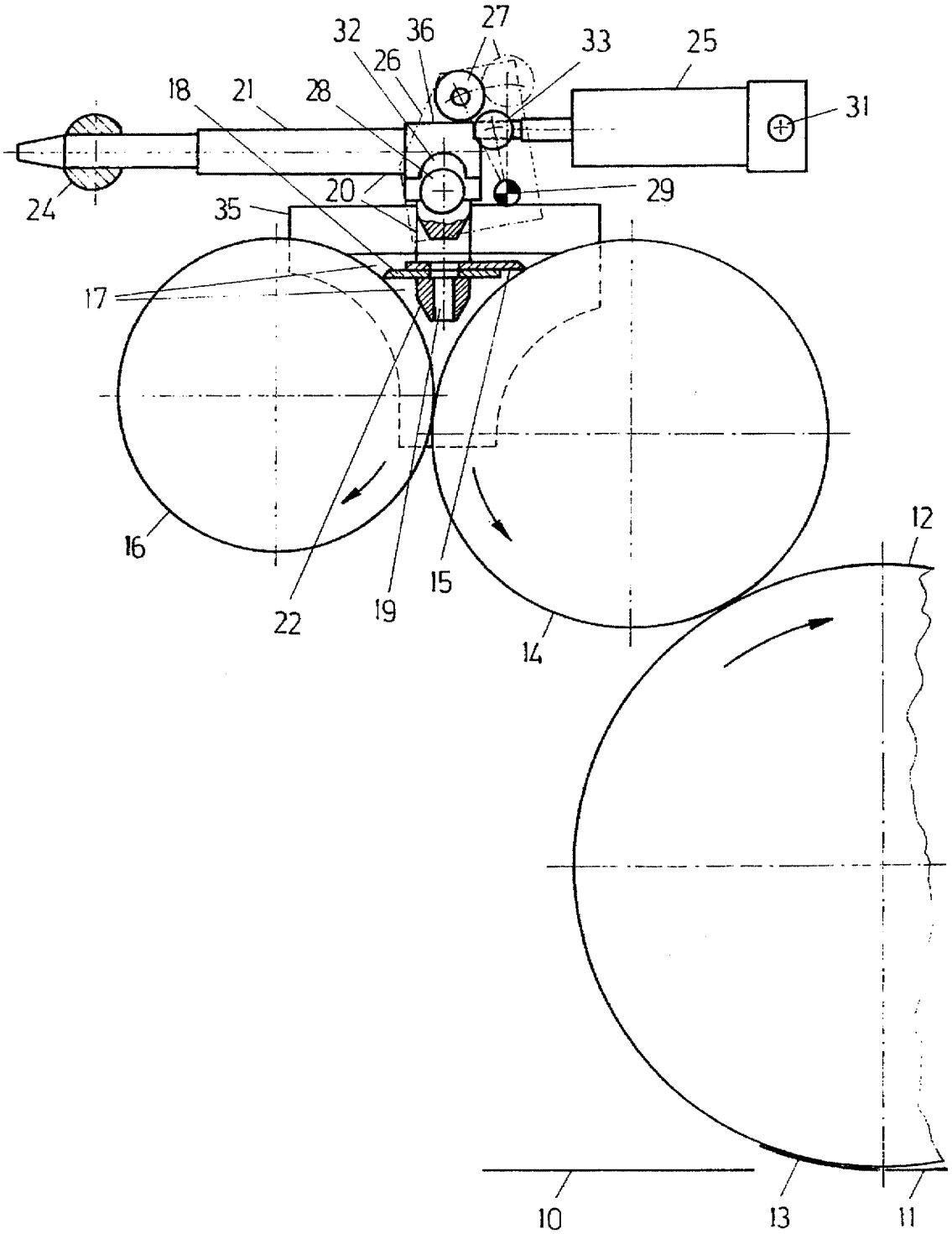
FIG. 1 shows a side cross-sectional view of an apparatus according to the present invention taken along line A—A i FIG. 2.
Figure 2:
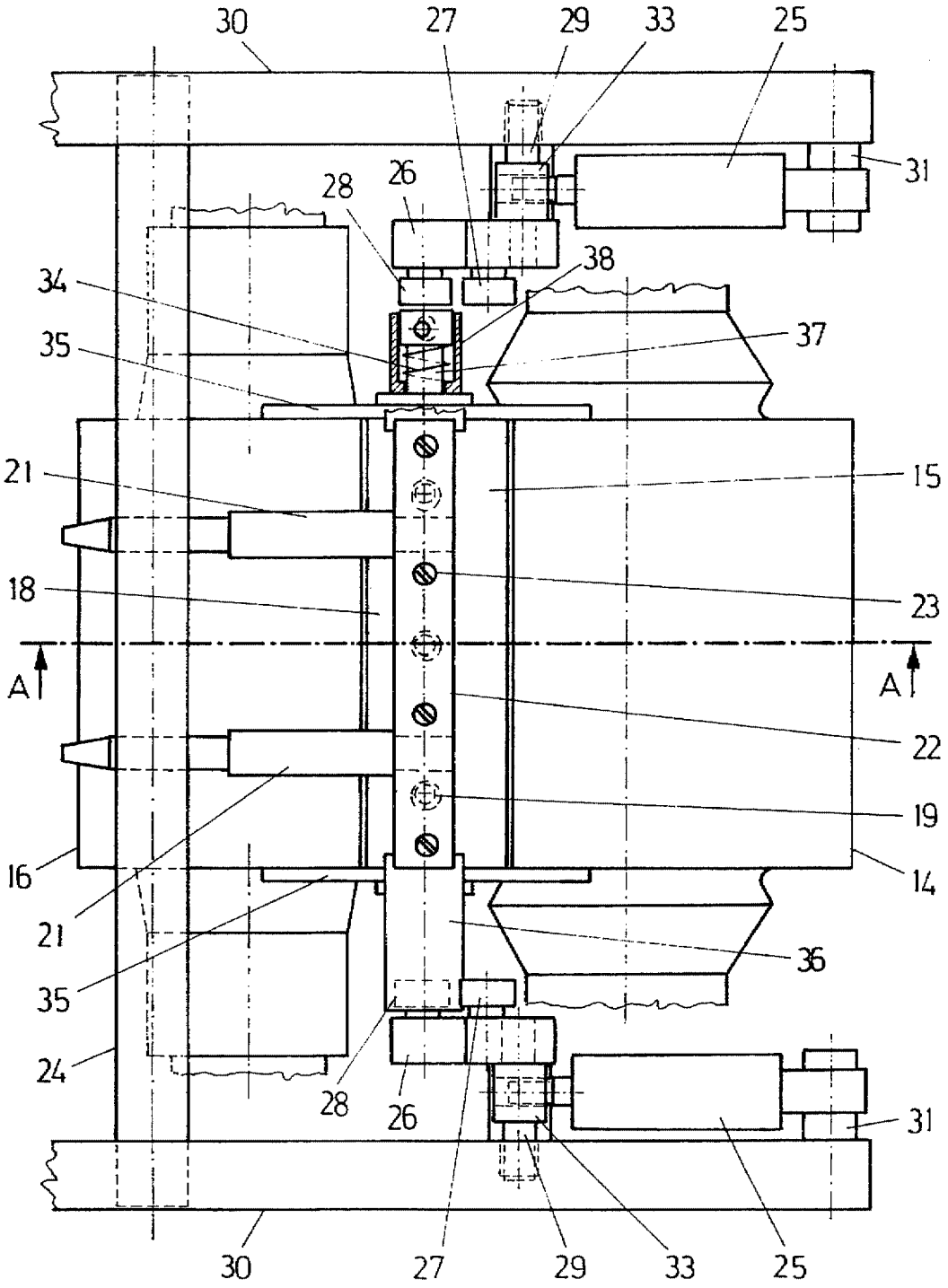
FIG. 2 shows a plan view of an apparatus according to the present invention.

FIG. 1 shows an apparatus according to the present invention for supplying a varnishing cylinder 12 of a sheet varnishing machine with a varnish film. FIG. 1 shows two plate-shaped metal sheets 10 and 11 movable one after another between the varnishing cylinder 12 and a pressure cylinder (not shown). The two sheets 10 and 11, the outer surfaces of which are varnished, upon moving past the varnishing cylinder 12, form thereon an unusable varnish field 13 which, upon further rotation of the cylinder 12, is transferred onto a varnish feed roller 14. This varnish deposition is removed with a scrapper blade 15, which engages the varnish feed roller 14, preferably, within varnish basin 17 formed between the varnish feed roller 14 and a pressure roller 16, before the renewal of the varnish film provided on the varnishing cylinder 12. A corresponding renewal of the varnish film, which is formed on the pressure roller 16, is made possible by providing a scrapper blade 18 which engages the pressure roller 16 and is immersed in the varnish basic 17.

In addition, in order to integrate into varnish basin 17 as soon as possible all of the varnish splittings and varnish deposits, it is insured that no amount of mature varnish is deposited on both scrapper blades 15 and 18, which are completely emerged in the varnish basin 17 and extend their substantially horizontally. The advantage of this arrangement consists particularly in that the cleansing possibilities and the possibilities of a rapid varnish change, are improved. The scrapper blades 15 and 18 extend at a favorable angle, and the set-up forces of the two scrapper blades 15 and 18 can be better combined. To insure providing in the varnish basin 17 a varnish flow with the initial condition, at least one varnish flow opening 19 is provided between the two scrapper blades 15 and 18.

A common holding device 20 of the two scrapper blades 15 and 18 includes a support beam 22 having pivot arms 21 for pivoting both scrapper blades 15 and 18 upward from the varnish feed roller 14 and the pressure roller 16 and then back downward. This significantly facilitates cleaning and general maintenance of the apparatus for supplying the varnishing cylinder 12 with a varnish film. The flat bar-shaped scrapper blades 15 and 18 lie on each other with their wide sides and are releasably connected to the support beam 22 with common screws 23 inserted from above. The scrapper blade 15, the tapering portion of which is directed toward the varnish feed roller 14 which has a larger diameter than the pressure roller 16, occupies an upper position. In order to provide for self-adjustment at the division of the set-up force between the scrapper blades 15 and 18, the pivot arms 21 are longitudinally displaceable on a shaft 24 the axis of which is parallel to the axes of the feed roller 14 and the pressure roller 16. To insure a convenient dismounting and to accelerate the cleaning process, a plug-in connection is formed between each of the pivot arms 21 and the shaft 24.

On each of the opposite ends of the support beam 22, there is provided a roller carrier 26, which is pivoted by a pressure cylinder 25 and carries a pressure roller 27, which pivots backward into a release position of the support beam 22 to apply pressure to the scrapper blades, and a spacing roller 28 for deactivating the scrapper blades. The spacing roller 28 provides an intermediate position for both scrapper blades 15 and 18, which is located in the vicinity of their operational position and in which the two scrapper blades 15 and 18, together with their common holding device 20, are prevented from forcefully hitting the varnish feed roller 14 and the pressure roller 16. The pivot 29 of the roller carrier 26 is connected with a side plate 30 or a back-up side plate of the sheet varnishing machine. The same applies to a support member 31 for the pressure cylinder 25. In FIG. 1, the operational position of the pressure roller 27 is shown with a solid line, and the release position of the pressure roller 27 is shown with a dash line. The pressure roller 27 contacts the upper surface of the support beam 22, whereas the spacing roller 28 is engaged in a spherical recess 32 from beneath upon being displaced a gap of the support beam 22. For connecting the roller carrier 26 with the pressure cylinder 25, which is preferably actuated with a pressure air, there is provided a rotatable union 33.

On each of the small sides of the varnish basin 17, there is provided a skid wall 35, which pivots together with the respective one of the scrapper blades 15 and 18 and which is pressed against the end surfaces of the varnish feed roller 14 and the pressure roller 16 with a compression spring 34 supported against the support beam 22. The skid plates 35, which serves for limiting the varnish basin 17, further facilitate dismounting and cleaning of the scrapper blades 15 and 18. When a spare unit of the holding device 20, together with the scrapper blades 18, 18 and skid walls 35, is readily available, changing to another varnish is significantly accelerated, and the down-time of the sheet varnishing machine, which results from changing of the varnish, is reduced. The compression spring 34 is located beneath a thrust member 36 of the support beam 22 and inside of a spring cage 38 on a carrying bolt 37 of the support beam 22.

In order to achieve a high uniformity of a new varnish film, which is formed on the varnishing cylinder 12, even when the film thickness is very small, the varnish feed roller 14 and the pressure roller 16 are rotated in opposite directions and, in the region of the varnish basin 17, with a step-down speed. Advantageously, the circumferential speed of the pressure roller 16 is lower than the circumferential speed of the varnish feed roller by about from three to ten percent, because in this case the squeezing of the varnish is accompanied by shearing of the varnish. Due to the fact that the varnish feed roller 14, the pressure roller 16, and the varnishing cylinder 12, which is driven synchronously with the displacement of workpieces, have all different outer diameters, localized varnish splitting on the varnish feed roller 14 is prevented, since the unusable varnish field 13 of the varnishing cylinder is held stationary on the varnishing cylinder 12 to keep clean the bottom sides of the following one another sheets 10 and 11.

The varnish supplying apparatus is primarily designed for use in a sheet varnishing machine for varnishing plate-shaped thin metal sheets 10, 11, as they are shown in FIG. 1. However, the apparatus can be used for one-side varnishing of any plate-shaped and laminated workpieces, such as cardboard and paper work pieces. The improved varnishing process is particularly important when the free areas for a glue material are provided on the foldable blanks during varnishing.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. An apparatus for supplying a varnishing cylinder of a sheet varnishing machine with a varnishing film, the apparatus comprising:

a varnish feed roller for depositing the varnish film on the varnishing cylinder;

a pressure roller cooperating with the varnish feed roller for supplying the varnish film;

a varnish basin formed between the varnish feed roller and the pressure roller;

scrapper means comprising a first and second scrapper blades extending substantially horizontally and engaging the varnish feed roller and the pressure roller, respectively, the first and second scrapper blades being substantially submerged in the varnish basin; and common means for holding the first and second scrapper blades.

2. An apparatus as set forth in the claim 1, wherein a varnish flow opening is provided between the first and second blades.

3. An apparatus as set forth in claim 1, wherein the varnish feed roller and the pressure roller are rotatable in opposite directions and in a region of the varnish basin have a step-down speed.

4. An apparatus for supplying a varnishing cylinder of a sheet varnishing machine with a varnishing film, the apparatus comprising:

a varnish feed roller for depositing the varnish film on the varnishing cylinder;

a pressure roller cooperating with the varnish feed roller for supplying the varnish film;

a varnish basin formed between the varnish feed roller and the pressure roller;

scrapper means comprising a first and second scrapper blades engaging the varnish feed roller and the pressure roller, respectively, and submerged in the varnish basin;

common means for holding the first and second scrapper blades; and a support beam for supporting the first and second blades having pivot arms for pivoting the first and second blades upward away from the varnish feed and pressure rollers and then downward in an engaging position.

5. An apparatus as set forth in claim 4, wherein the pivot arms are displaceably supported on a shaft having an axis extending parallel to axes of the varnish feed roller and pressure roller.

6. An apparatus as set forth in claim 5, wherein plug-in connection is formed between each of the pivot arms and the supporting shaft.

7. An apparatus as set forth in claim 4, further comprising a roller carrier provided at each of the opposite ends of the support beam, a pressure cylinder for pivoting the roller carrier, and a pressure roller pivotable backward into a release position of the support beam for applying pressure to a respective scrapper blade, and a spacing roller for deactivating the respective scrapper blade.

8. An apparatus as set forth in claim 4, further comprising a skid wall, which is provided on each of small sides of the varnish basin and which pivots together with a respective scrapper blade, and a compression spring supported on the support beam for biasing the skid wall to a respective end surfaces of the varnish feed and pressure rollers.

* * * * *

UNITED STATES PATENT AND TRADEMARK OFFICE

CERTIFICATE OF CORRECTION

PATENT NO. : 5,667,589

DATED : September 16, 1997

INVENTOR(S) : Udo Mailänder

It is certified that error appears in the above-indentified patent and that said Letters Patent is hereby corrected as shown below:

On the title page, item [73], should read:

Assignee: LTG Lufttechnische GMBH, Stuttgart, Germany

Signed and Sealed this

Eleventh Day of November, 1997

*Attest:*

BRUCE LEHMAN

*Attesting Officer*

*Commissioner of Patents and Trademarks*